US008475083B2

(12) United States Patent
Dunn et al.

(10) Patent No.: US 8,475,083 B2
(45) Date of Patent: Jul. 2, 2013

(54) UMBILICAL FOR UNDERWATER DIVING

(75) Inventors: Malcolm Harry Dunn, St Andrews (GB); Donald Walker, St Andrews (GB)

(73) Assignee: University Court of The University of St. Andrews, St. Andrews (GB)

( * ) Notice: Subject to any disclaimer, the term of this patent is extended or adjusted under 35 U.S.C. 154(b) by 362 days.

(21) Appl. No.: 12/751,664

(22) Filed: Mar. 31, 2010

(65) Prior Publication Data

US 2011/0240018 A1 Oct. 6, 2011

(51) Int. Cl.
*B63C 11/26* (2006.01)

(52) U.S. Cl.
USPC ..... 405/186; 405/185; 362/554; 340/850; 385/88; 385/100; 385/115

(58) Field of Classification Search
USPC .. 405/185, 186, 188, 189, 190, 191; 362/267, 362/554; 385/1, 2, 88, 89, 100, 101, 114, 385/115, 116; 340/850
See application file for complete search history.

(56) References Cited

U.S. PATENT DOCUMENTS

| | | | | |
|---|---|---|---|---|
| 4,021,661 | A * | 5/1977 | Levine | 385/116 |
| 4,804,849 | A * | 2/1989 | Booth et al. | 356/221 |
| 5,301,668 | A * | 4/1994 | Hales | 340/525 |
| 5,377,165 | A * | 12/1994 | LaPointe et al. | 367/134 |
| 5,408,562 | A * | 4/1995 | Yoshizawa et al. | 385/112 |
| 6,347,172 | B1 * | 2/2002 | Keller et al. | 385/102 |
| 6,390,012 | B1 * | 5/2002 | Watt et al. | 114/322 |
| 6,394,625 | B2 * | 5/2002 | Demaria | 362/249.02 |
| 6,546,174 | B2 * | 4/2003 | Clarkin | 385/100 |
| 6,592,245 | B1 * | 7/2003 | Tribelsky et al. | 362/551 |
| 6,679,619 | B2 * | 1/2004 | Saieva | 362/267 |
| 6,742,916 | B1 | 6/2004 | Dunn | |
| 6,999,641 | B2 * | 2/2006 | Williams et al. | 385/104 |
| 7,058,305 | B2 * | 6/2006 | Horinouchi et al. | 340/850 |
| 7,178,941 | B2 * | 2/2007 | Roberge et al. | 362/225 |
| 7,217,022 | B2 * | 5/2007 | Ruffin | 362/554 |
| 7,217,024 | B2 * | 5/2007 | Good et al. | 362/554 |
| 7,234,828 | B2 * | 6/2007 | Kelly et al. | 362/84 |
| 7,398,697 | B2 * | 7/2008 | Allen et al. | 73/800 |
| 2002/0090182 | A1 * | 7/2002 | Clarkin | 385/100 |
| 2003/0112639 | A1 * | 6/2003 | Stack | 362/552 |
| 2004/0136192 | A1 * | 7/2004 | Saieva | 362/267 |
| 2004/0228144 | A1 * | 11/2004 | Squicciarini | 362/555 |
| 2006/0001428 | A1 * | 1/2006 | Milne et al. | 324/360 |
| 2006/0201293 | A1 * | 9/2006 | Tufte | 83/13 |
| 2006/0251144 | A1 | 11/2006 | Nagano et al. | |
| 2007/0183782 | A1 * | 8/2007 | Farr et al. | 398/104 |
| 2007/0189031 | A1 * | 8/2007 | Delmar | 362/556 |
| 2008/0049440 | A1 * | 2/2008 | Gaydoul | 362/556 |
| 2008/0300742 | A1 * | 12/2008 | Weaver et al. | 114/312 |
| 2011/0227753 | A1 * | 9/2011 | Iffergan | 340/850 |

FOREIGN PATENT DOCUMENTS

| | | | |
|---|---|---|---|
| GB | 1523163 | A | 8/1978 |
| GB | 2214004 | A | 8/1989 |
| WO | WO-9635928 | A1 | 11/1996 |
| WO | WO-9835181 | A1 | 8/1998 |
| WO | WO-2006026720 | A2 | 3/2006 |

* cited by examiner

*Primary Examiner* — Frederick L Lagman
(74) *Attorney, Agent, or Firm* — W. Kevin Ransom; Moore & Van Allen, PLLC

(57) ABSTRACT

An umbilical comprising a side-emitting optical fiber or optical fiber-bundle for providing a distributed source of light along part or the whole of the length of the umbilical.

68 Claims, 5 Drawing Sheets

UMBILICAL FOR UNDERWATER DIVING

FIELD OF THE INVENTION

This invention is concerned with the illumination of umbilicals, as employed in subsea surface-air diving and subsea saturation diving, for the purpose of improved diver safety and efficiency of working.

BACKGROUND OF THE INVENTION

In commercial subsea diving, supply of air to the diver from the surface is the preferred method (as compared to the use of bottled air carried by the diver) since such a supply scheme places less stringent limitations on diver operating time underwater. Surface supplied air requires the diver to be linked to the surface through an umbilical for the supply of the air along with other services.

In commercial surface air diving umbilical lengths of 75 m with depths down to 50 m combined with an underwater operating radius of up to 25 m typically need to be covered. Alternatively, through the use of saturation diving techniques depths down to 300 m can be reached through the use of a diving bell. In this case an umbilical is required to connect the diver to the bell for the supply of air, with a requirement for the diver being able to operate over a radius of up to 75 m from the bell. In addition umbilicals may be required to connect remote operating vehicles (ROV) or their derivatives to a bell or other installations.

Subsea commercial surface-air diving is globally important in the contexts of off-shore, submerged tidal and ocean power generation installations, wind farms, harbor clearance, pipeline inspection, and wreck inspection/salvage. In addition saturation diving techniques are required in connection with the inspection and maintenance of oil platforms, and submerged well heads, at depths where surface air diving cannot reach. One of the dangers faced by divers in these environments is entanglement or fouling of their umbilicals, which can significantly compromise diver safety and security.

SUMMARY OF THE INVENTION

According to one aspect of the present invention, there is provided an umbilical that comprises at least one side emitting optical fiber that extends along the length of the umbilical. An illumination source is provided at either one or both ends of the at least one fiber.

By using a side emitting light fiber rope, the umbilical can be illuminated along its length, thereby alleviating some of the risks faced by divers. Such an umbilical has numerous advantages. For example, it can provide a guide-path to the surface and provides general illumination of the sub sea environment within which the diver or divers are working. This improves the working conditions, and thereby increases efficiency of working. This is particularly important in situations where working time is limited by external constraints, as in the case of sub sea working. An illuminated umbilical also provides individual divers engaged with others on common tasks with an improved overall visual sense of the communal working environment.

The light rope umbilical of the present invention provides a distributed illumination source that is: capable of being installed as one element/strand of the overall umbilical; service-free within the usual lifetime of the umbilical; capable of being pre-installed as part of the standard manufacturing process for umbilicals, and activated if and when required without further modification of the umbilical; capable of withstanding the rigors of the sub sea environment, particularly with regard to the impact of salt water; physically robust, thereby not suffering damage or failure as a consequence of being incorporated within the bundle of other connections associated with the umbilical; capable of being illuminated without requiring a distributed electrical or other supply along the length of the source for this purpose (i.e. it is a passive source along the length of the umbilical); and capable of withstanding local failure/damage at points along its length without undergoing universal failure.

At least one illuminating source may be coupled to the optical fiber or optical fiber-bundle. The illuminating source may be a light emitting diode (LED). The illuminating source may be at least one of: a laser; a diode laser; a diode-laser-pumped solid-state laser.

The umbilical may include a converter for converting the frequency of light from the source.

The light may be modulated to carry a message or information. The light modulation may be visible directly by eye, for example as in the case of a general warning message. Additionally or alternatively, an optical receiver may be provided for decoding the modulated message for presentation to a user.

Means may be provided for presenting the message to the user visually and/or orally.

The umbilical may include at least one of a tube or hose; a cable for supplying power; a communications link. The at least one tube or hose may be provided for supplying gas, for example air, or fluid, for example water. The optical fiber or optical fiber bundle may be wound round or intertwined with one or all of the tube or hose, the cable and the communications link.

The illuminating source may be contained within a housing. The housing may have a window that is transparent to light from the source. A coupling element may be provided for pressing the end of the fiber or fiber bundle against the window to provide a butt coupled optical connection. The housing may be waterproof. The housing may be pressurized.

A controller may be provided for controlling an output of the illuminating source. The controller may be adapted to cause flashing and/or a change in color of the light emitted.

The umbilical may be adapted for use as a diver umbilical. The umbilical may be adapted for use between a surface and a subsea location and/or between a diving bell and an individual diver and/or between two or more locations subsea or surface to sea.

The umbilical may be adapted to be connected to an underwater remote operating vehicle.

BRIEF DESCRIPTION OF THE DRAWINGS

Various aspects of the invention will now be described by way of example only and with reference to the accompanying drawings, of which.

DETAILED DESCRIPTION OF THE DRAWINGS

Figure 1:
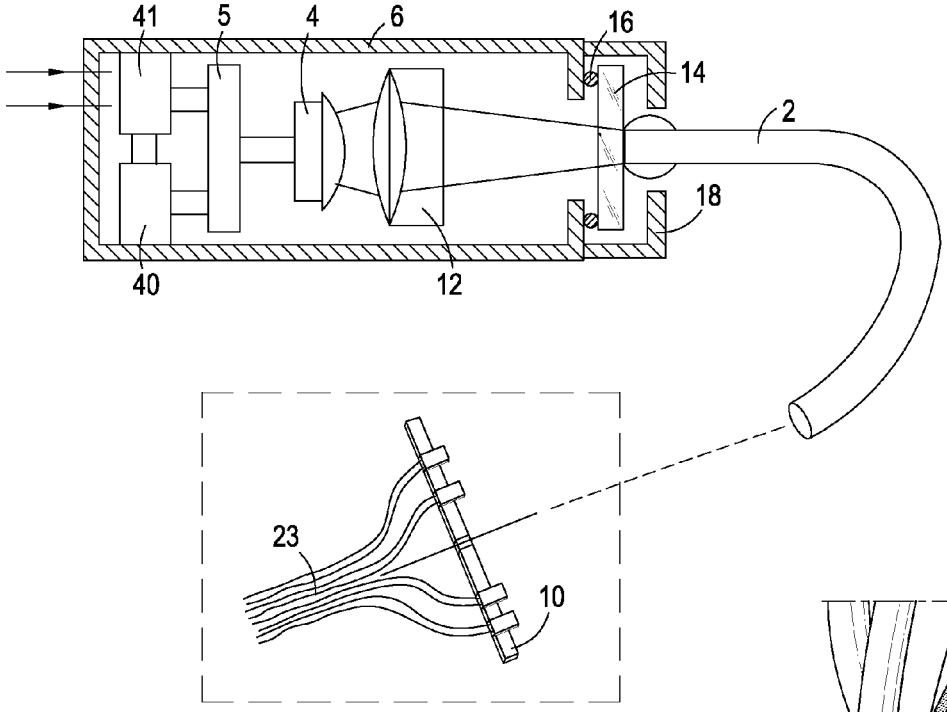
FIG. 1 is a schematic representation of a light rope umbilical system.
Figure 2:
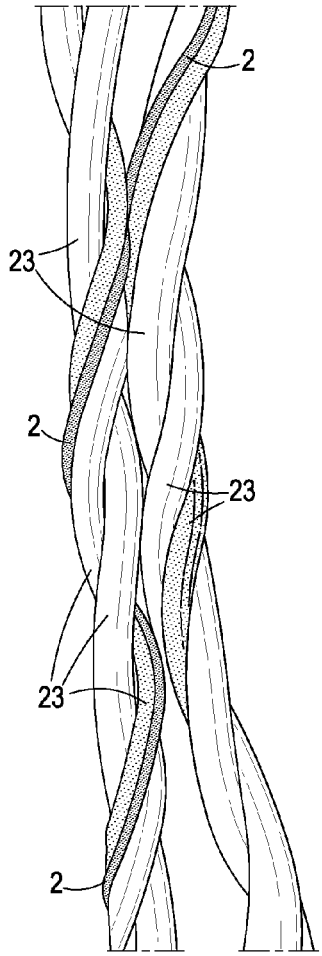
FIG. 2 is a view of a fiber-bundle as incorporated within the umbilical.

FIGS. 1 and 2 show an umbilical in accordance with the invention. This has various conventional umbilical parts 23 that are wound together, such as a gas hose and a power line, as best seen in FIG. 2. In addition, the umbilical of the invention includes a fiber-bundle 2 that has multiple side-emitting optical fibers. The side-emitting optical fibers provide a distributed source of light that allows the umbilical to be lit along its length, thereby providing a guide-path as well as general illumination of the sub sea environment within which the diver or divers are working.

For the purpose of illuminating the fiber bundle 2 a light emitting diode (LED) 4 is provided powered by a driver 5. The LED 4 is enclosed within a compact watertight enclosure or light-box 6 which is located adjacent to an umbilical interconnect-interface 10. Radiation from the LED passes through an optical coupling arrangement 12 which transforms the spatial characteristics of the primary radiation from the LED to optimize its coupling into the fiber-bundle 2. The radiation then passes through a window 14 which is mounted on a water-tight seal 16 on the side of the watertight compartment 6, before entering the fiber-bundle 2. The prepared ends of the fibers making up the bundle are held in compression by element 18 so as to be in contact with and hence butt-coupled to the outer surface of the window. The optical arrangement described is such that this location of the fiber-end also optimizes the coupling of the radiation into the fiber.

Whilst any LED may be used, in a preferred example, the LED generates light in the green spectral region. Typically for an electrical input power to the LED of 12 W, the optical output power from the LED in the green spectral region is of the order of 400 mW, and the coupling efficiency for this radiation into the fiber is of the order of 23-28%.

Figure 3:
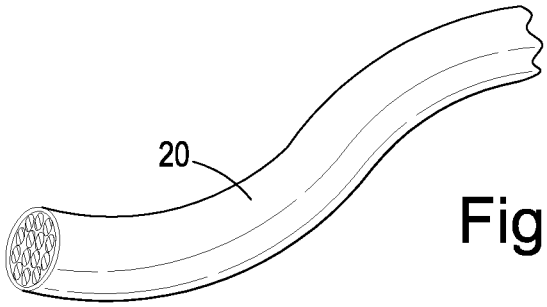
FIG. 3 is a side view of an individual fiber of a light rope for use in the system of FIG. 1.
Figure 4:
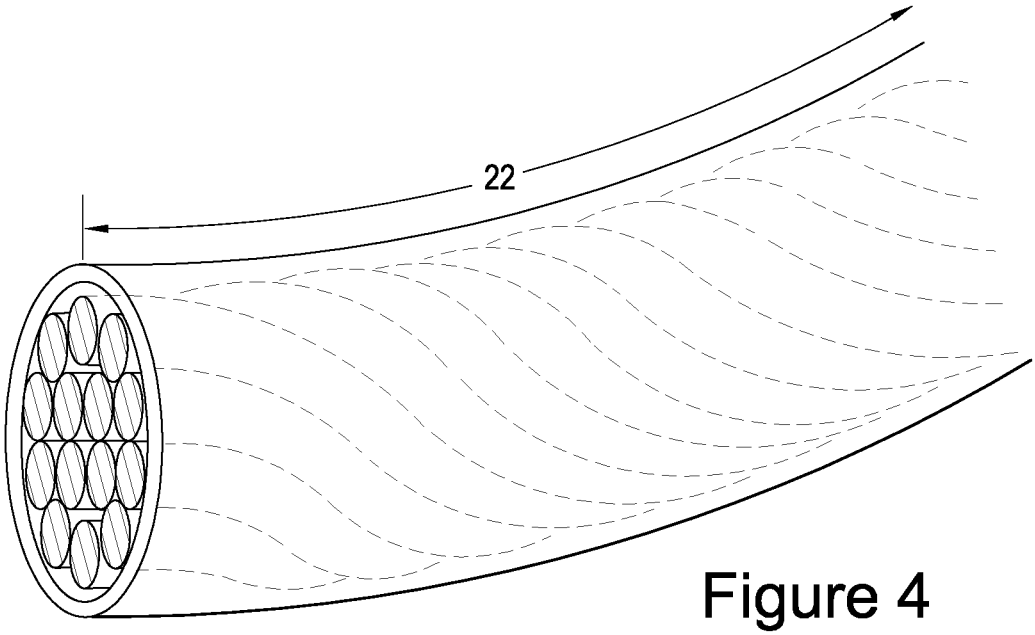
FIG. 4 is a view of a fiber bundle showing helical pitch.

The fiber bundle may be made up of any number of fibers. In a preferred example fourteen individual plastic fibers 20 are used with a core diameter of 0.74 mm and refractive index of 1.49, and with an outer cladding of wall thickness 0.06 mm and refractive index 1.40, see FIG. 3. As a specific example these fibers would conform to Eska CK30 fiber. The fibers are wound in a tight helical bundle 22 with a pitch of 10 cm, see FIG. 4. The packing of the fibers as appears at each end of the bundle is of the form of 4 central fibers surrounded by 10 other fibers 20, all encased within an outer sheath 26 that is transparent to the light that is to be used, see FIG. 5. The plastic sheaf 26 has a nominal wall thickness of 0.85 mm, the walls of the sheaf being transparent to the green radiation. Typically the fiber bundle 2 would be of length 100 m, compatible with a standard umbilical, 23.

Figure 5:
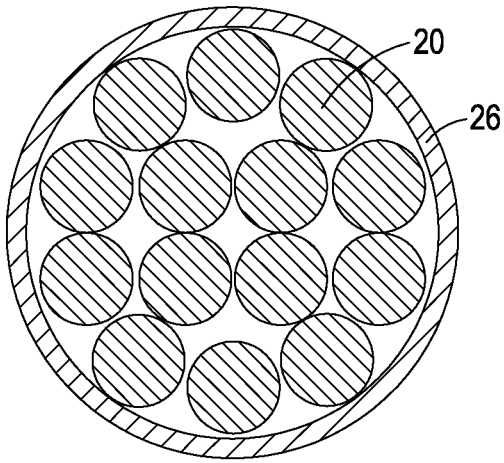
FIG. 5 is an end view of bundle showing arrangement of individual fibers and sleeving.

The fiber-bundle geometry of FIG. 5 typically experiences a loss of the order of 5%/m due to radiation escaping through the side walls as required, this being determined both by the tightness of winding and the compression of the bundle by the outer sleeve. Both these aspects are controllable for the purposes of optimization during the manufacturing process. For the specifications given above satisfactory illumination and brightness of emission is attained for fiber lengths up to 100 m. The watertight compartment 6 also contains a back-up battery 40 (3 hours of steady state lighting or 6 hours on flash) with a built in charger circuit 41. This circuit 41 contains the flash interface which is controlled from the surface by the dive supervisor. This will also allow remote operation in the event on no mains. The system in normal operation requires 12 W @18V DC.

In some circumstances, it may be desirable to allow the injection of light from both ends of the fiber. Another arrangement is where the fiber is illuminated from both ends, namely from the surface end of the fiber as described above and also from the underwater end as attached to the diver. For the latter purpose FIG. 6 shows a compact watertight pressurized light-box 28 designed to operate at depth of typical dimensions 100 mm×50 mm diameter which is attached at the diver end to the fiber and contains a rechargeable battery 30, LED 32, associated driver circuit 34, optical coupling arrangement 36, and output coupling window 38 with facility for butt-coupling the fiber-ends as previously.

Figure 6:
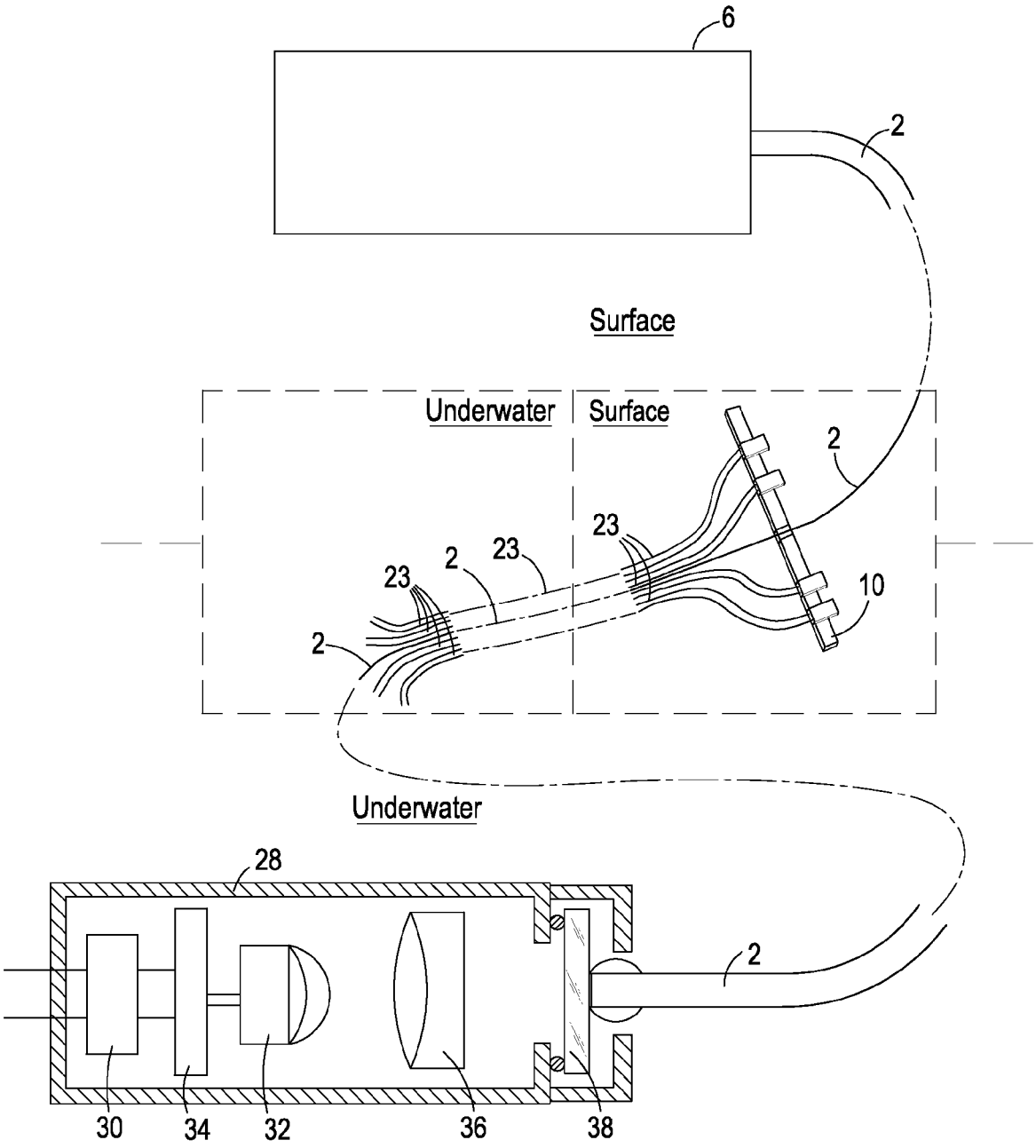
FIG. 6 shows the illuminator at the diver end for a fiber-bundle umbilical illuminated from both ends.
Figure 7A:
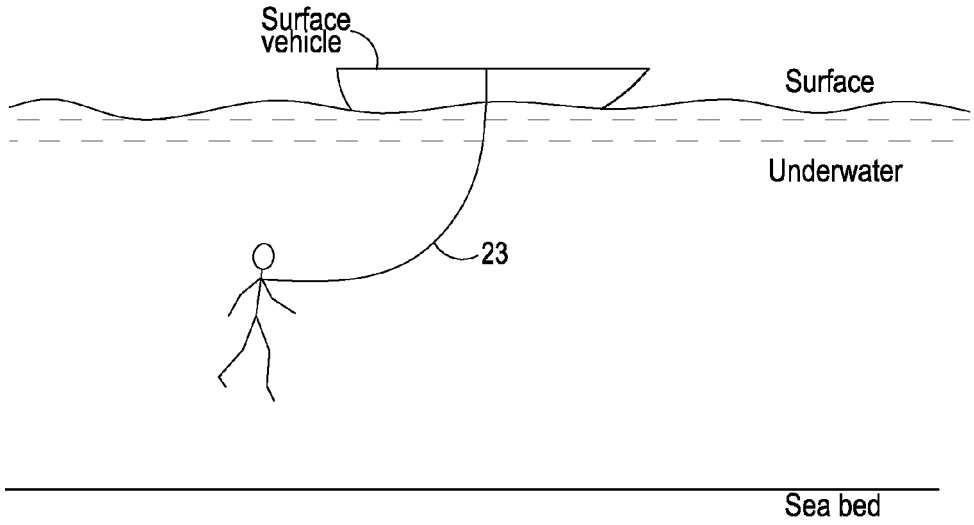
FIG. 7 shows the umbilical in use in various operational environments.
Figure 7B:
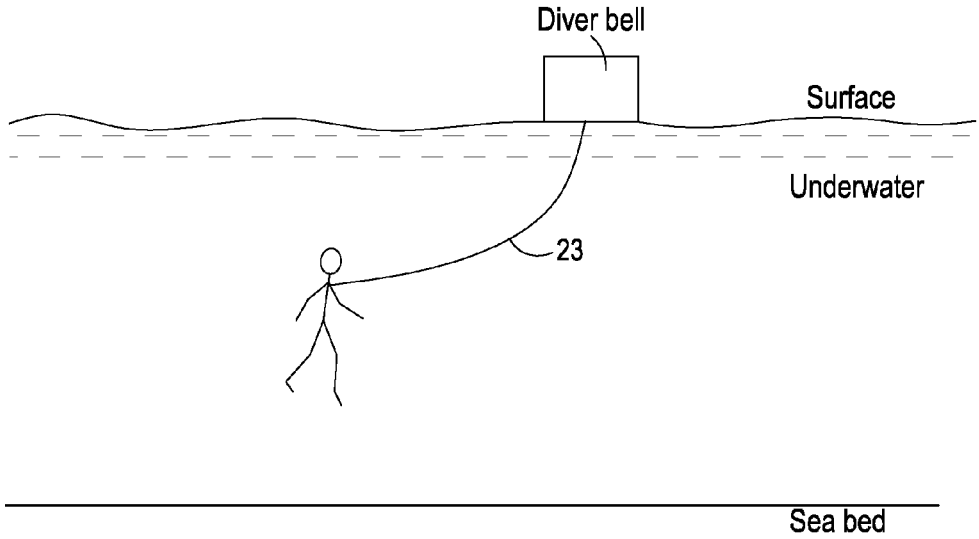
Figure 7C:
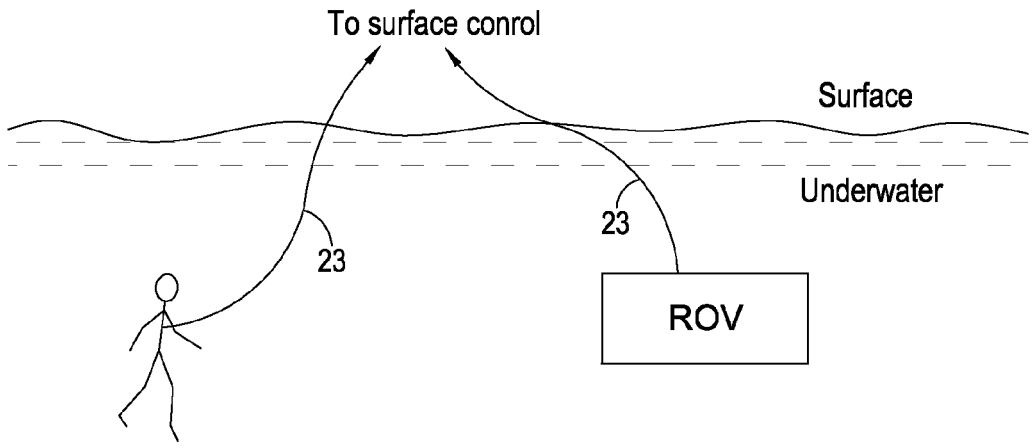
Figure 7D:
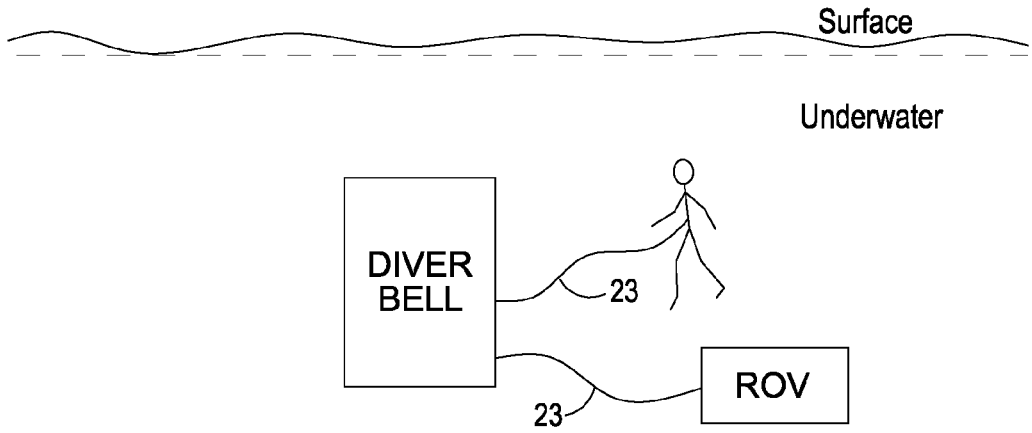

Overall characteristics for the underwater source for use in the arrangement of FIG. 6 regarding optical power into fiber, etc. are similar to the surface based illuminator. Under normal operating conditions the system is powered by the diver's electrical supply emanating from the surface and provided by the power cable of the umbilical, but with a battery back-up of one hour. This arrangement significantly increases illumination levels in the vicinity of the diver(s), and provides back-up through built-in redundancy in the event of fiber damage or light source failure. It can also significantly increase umbilical operational length.

The light injected into the fiber bundle may be modulated so as to carry a message or information. The modulation of light may be such that it can be seen directly by eye, for example in the case of a general warning message. Alternatively or additionally, an optical receiver capable of decoding the modulated message may be provided for subsequent oral, visual or other mode of presentation to divers or other relevant parties.

A controller (not shown) may be provided at one or both ends of the umbilical to cause the light emitted from the fibers to be altered. For example, the light could be caused to flash on and off. This could be used by divers in emergency situations to provide a general warning, for example, highlighting a change in operational conditions or a specific diver in difficulty, thereby making colleagues immediately aware of a changed state. A lit and flashing umbilical could speed up rescue operations in identifying the diver at risk.

FIG. 7 shows various different operational environments in which the umbilical of the invention could be used. These include between the surface and a subsea location (surface-air diving application), FIG. 7(*a*) or between a diving bell and individual divers (saturation diving), FIG. 7(*b*). It may also be used between two or more subsea locations for example in connection with remote operating vehicles (ROVs), as shown in FIG. 7(*c*) and FIG. 7(*d*).

The present invention provides a safe, low-power light-source that is continuous, flexible and distributed along the full length of the umbilical. The source can be used in any underwater environment for example subsea and any inland waters including lakes, rivers, lochs, harbors, docks, canals and all other types of waterways. The source requires no electrical power within the structure of the umbilical itself and can provide high intensity light at the peak eye response, as well as light of other colors if required. It provides a clear return path back to safety resulting from the distributed and continuous nature of the source along the length of the umbilical. It provides visual information between divers as to their relative locations in the subsea environment, as well as general illumination of the underwater working environment thereby increasing the visual acuity of operatives so improving both their safety and their efficiency of working.

A skilled person will appreciate that variations of the disclosed arrangements are possible without departing from the invention. For example, although the invention is described with reference to a bundle of fibers, a single fiber or a light pipe may be used. Equally, the illuminator may be any suitable device, such as a filament/halogen/thermal resistance illuminator, or a laser, for example a diode laser, such as a diode-laser-pumped solid-state laser. The wavelength of the radiation generated by the laser may be shifted in frequency by some optically nonlinear technique so as to be suited to the purpose. Whilst green is a preferred color any spectral color may be used. Accordingly the above description of the specific embodiment is made by way of example only and not for the purposes of limitation. It will be clear to the skilled person that minor modifications may be made without significant changes to the operation described.

The invention claimed is:

1. An umbilical comprising:

at least one of a tube or a hose, wherein the at least one tube or hose is configured for supplying gas or fluid; and a side-emitting optical fiber or a bundle of side-emitting optical fibers for providing a distributed source of light along part or the whole of a length of the umbilical.

2. An umbilical as claimed in claim 1 comprising at least one illuminating source coupled to the optical fiber or optical fiber-bundle.

3. An umbilical as claimed in claim 2 where the illuminating source is a light emitting diode (LED).

4. An umbilical as claimed in claim 3 comprising a converter for converting the frequency of light from the source.

5. An umbilical as claimed in claim 2 wherein the illuminating source is at least one of: a laser; a diode laser; a diode-laser-pumped solid-state laser.

6. An umbilical as claimed in claim 2 wherein the illuminating source is contained within a housing.

7. An umbilical as claimed in claim 6 wherein the housing has a window that is transparent to light from the source.

8. An umbilical as claimed in claim 7 wherein a coupling element is provided for pressing the end of the fiber or fiber bundle against the window to provide a butt coupled optical connection.

9. An umbilical as claimed in claim 6 wherein the housing is waterproof.

10. An umbilical as claimed in claim 6 wherein the housing is pressurized.

11. An umbilical as claimed in claim 2 wherein a controller is provided for controlling an output of the illuminating source.

12. An umbilical as claimed in claim 11 wherein the controller is adapted to cause flashing and/or a change in color of the light emitted.

13. An umbilical as claimed in claim 1 wherein the light is modulated to carry a message or information.

14. An umbilical as claimed in claim 13 wherein the light modulation is visible directly by eye, for example as in the case of a general warning message.

15. An umbilical as claimed in claim 13 wherein an optical receiver is provided for decoding the modulated message for presentation to a user.

16. An umbilical as claimed in claim 15 comprising means for presenting the message to the user visually and/or orally.

17. An umbilical as claimed in claim 1 further comprising a cable for supplying power; and a communications link.

18. An umbilical as claimed in claim 17 wherein the optical fiber or optical fiber bundle is wound around one or all of the tube or hose, the cable and the communications link.

19. An umbilical as claimed in claim 1 adapted for use as a diver umbilical.

20. An umbilical as claimed in claim 19 wherein the umbilical is adapted for use between a surface and a subsea location.

21. An umbilical as claimed in claim 19 wherein the umbilical is adapted for use between a diving bell and an individual diver.

22. An umbilical as claimed in claim 19 wherein the umbilical is adapted for use between two or more locations subsea or surface to sea.

23. An umbilical as claimed in claim 19 wherein the umbilical is adapted to be connected to an underwater remote operating vehicle.

24. An umbilical comprising a side-emitting optical fiber or a bundle of side-emitting optical fibers for providing a distributed source of light along part or the whole of the length of the umbilical, wherein said umbilical is adapted for use as a diver umbilical.

25. An umbilical as claimed in claim 24 comprising at least one illuminating source coupled to the optical fiber or optical fiber-bundle.

26. An umbilical as claimed in claim 25 where the illuminating source is a light emitting diode (LED).

27. An umbilical as claimed in claim 26 comprising a converter for converting the frequency of light from the source.

28. An umbilical as claimed in claim 25 wherein the illuminating source is at least one of: a laser; a diode laser; a diode-laser-pumped solid-state laser.

29. An umbilical as claimed in claim 25 wherein the illuminating source is contained within a housing.

30. An umbilical as claimed in claim 29 wherein the housing has a window that is transparent to light from the source.

31. An umbilical as claimed in claim 30 wherein a coupling element is provided for pressing the end of the fiber or fiber bundle against the window to provide a butt coupled optical connection.

32. An umbilical as claimed in claim 29 wherein the housing is waterproof.

33. An umbilical as claimed in claim 29 wherein the housing is pressurized.

34. An umbilical as claimed in claim 25 wherein a controller is provided for controlling an output of the illuminating source.

35. An umbilical as claimed in claim 34 wherein the controller is adapted to cause flashing and/or a change in color of the light emitted.

36. An umbilical as claimed in claim 24 wherein the light is modulated to carry a message or information.

37. An umbilical as claimed in claim 36 wherein the light modulation is visible directly by eye, for example as in the case of a general warning message.

38. An umbilical as claimed in claim 36 wherein an optical receiver is provided for decoding the modulated message for presentation to a user.

39. An umbilical as claimed in claim 38 comprising means for presenting the message to the user visually and/or orally.

40. An umbilical as claimed in claim 24 further comprising at least one of a tube or hose; a cable for supplying power; and a communications link.

41. An umbilical as claimed in claim 40 wherein the at least one tube or hose is provided for supplying gas or fluid.

42. An umbilical as claimed in claim 40 wherein the optical fiber or optical fiber bundle is wound around one or all of the tube or hose, the cable and the communications link.

43. An umbilical as claimed in claim 24 wherein the umbilical is adapted for use between a surface and a subsea location.

44. An umbilical as claimed in claim 24 wherein the umbilical is adapted for use between a diving bell and an individual diver.

45. An umbilical as claimed in claim 24 wherein the umbilical is adapted for use between two or more locations subsea or surface to sea.

46. An umbilical as claimed in claim 24 wherein the umbilical is adapted to be connected to an underwater remote operating vehicle.

47. An umbilical comprising:

a side-emitting optical fiber or a bundle of side-emitting optical fibers; and at least one illuminating source coupled to the optical fiber or optical fiber-bundle for providing a distributed source of light along part or the whole of the length of the umbilical, wherein the illuminating source is contained within a housing, and wherein the housing has a window that is transparent to light from the source.

48. An umbilical as claimed in claim 47 where the illuminating source is a light emitting diode (LED).

49. An umbilical as claimed in claim 48 comprising a converter for converting the frequency of light from the source.

50. An umbilical as claimed in claim 47 wherein the illuminating source is at least one of: a laser; a diode laser; a diode-laser-pumped solid-state laser.

51. An umbilical as claimed in claim 47 wherein the light is modulated to carry a message or information.

52. An umbilical as claimed in claim 51 wherein the light modulation is visible directly by eye, for example as in the case of a general warning message.

53. An umbilical as claimed in claim 51 wherein an optical receiver is provided for decoding the modulated message for presentation to a user.

54. An umbilical as claimed in claim 53 comprising means for presenting the message to the user visually and/or orally.

55. An umbilical as claimed in claim 47 further comprising at least one of a tube or hose; a cable for supplying power; and a communications link.

56. An umbilical as claimed in claim 55 wherein the at least one tube or hose is provided for supplying gas or fluid.

57. An umbilical as claimed in claim 55 wherein the optical fiber or optical fiber bundle is wound around one or all of the tube or hose, the cable and the communications link.

58. An umbilical as claimed in claim 47 wherein a coupling element is provided for pressing the end of the fiber or fiber bundle against the window to provide a butt coupled optical connection.

59. An umbilical as claimed in claim 47 wherein the housing is waterproof.

60. An umbilical as claimed in claim 47 wherein the housing is pressurized.

61. An umbilical as claimed in claim 47 wherein a controller is provided for controlling an output of the illuminating source.

62. An umbilical as claimed in claim 61 wherein the controller is adapted to cause flashing and/or a change in color of the light emitted.

63. An umbilical as claimed in claim 47 adapted for use as a diver umbilical.

64. An umbilical as claimed in claim 63 wherein the umbilical is adapted for use between a surface and a subsea location.

65. An umbilical as claimed in claim 63 wherein the umbilical is adapted for use between a diving bell and an individual diver.

66. An umbilical as claimed in claim 63 wherein the umbilical is adapted for use between two or more locations subsea or surface to sea.

67. An umbilical as claimed in claim 63 wherein the umbilical is adapted to be connected to an underwater remote operating vehicle.

68. An umbilical comprising:

a side-emitting optical fiber or a bundle of side-emitting optical fibers;

at least one illuminating source coupled to the optical fiber or optical fiber-bundle for providing a distributed source of light along part or the whole of the length of the umbilical, wherein the light is modulated to carry a message or information; and an optical receiver for decoding the modulated message or information for presentation to a user.

* * * * *